US006865836B2

(12) United States Patent
Sachs-Lavery

(10) Patent No.: US 6,865,836 B2
(45) Date of Patent: Mar. 15, 2005

(54) PICTURE FRAME SYSTEM

(76) Inventor: Tracy Sachs-Lavery, 20 Maryanne La., Stamford, CT (US) 06905

( * ) Notice: Subject to any disclaimer, the term of this patent is extended or adjusted under 35 U.S.C. 154(b) by 0 days.

(21) Appl. No.: 10/336,599

(22) Filed: Jan. 3, 2003

(65) Prior Publication Data

US 2004/0128894 A1 Jul. 8, 2004

(51) Int. Cl.[7] ..... A47G 1/08

(52) U.S. Cl. ..... 40/741; 40/711; 40/760; 248/467

(58) Field of Search ..... 40/711, 739, 741, 40/760; 248/467

(56) References Cited

U.S. PATENT DOCUMENTS

| | | | | | |
|---|---|---|---|---|---|
| 1,771,039 | A | | 7/1930 | Hedglon | |
| 3,456,374 | A | | 7/1969 | Baermann | |
| 3,553,872 | A | | 1/1971 | Ebner | |
| 3,553,873 | A | | 1/1971 | Weston | |
| 3,827,020 | A | * | 7/1974 | Okamoto | 335/285 |
| 4,024,659 | A | | 5/1977 | Ingerdahl | |
| 4,211,382 | A | * | 7/1980 | Bonfils | 248/467 |
| 4,258,493 | A | * | 3/1981 | Kettlestrings et al. | 40/600 |
| 4,605,292 | A | * | 8/1986 | McIntosh | 359/870 |
| 4,785,562 | A | | 11/1988 | Good | |
| 4,852,282 | A | | 8/1989 | Selman | |
| 4,912,864 | A | | 4/1990 | Price | |
| 5,195,263 | A | * | 3/1993 | Huang | 40/761 |
| 5,448,841 | A | | 9/1995 | Hampton | |
| 5,579,596 | A | | 12/1996 | Kovacs et al. | |
| 6,052,933 | A | | 4/2000 | Lytle | |
| 6,569,521 | B1 | * | 5/2003 | Sheridan et al. | 428/343 |
| 6,742,295 | B2 | * | 6/2004 | Gross | 40/711 |
| 2003/0121193 | A1 | * | 7/2003 | Kim | 40/711 |

* cited by examiner

*Primary Examiner*—Andrew D. Wright
(74) *Attorney, Agent, or Firm*—Gordon & Jacobson, PC

(57) ABSTRACT

A framing system suitable for framing artwork, drawings, pictures and the like and mounting the framed work on a surface includes at least one frame member that cooperates with a plurality of mounting elements to surround the work with the frame member(s) and mount the resultant framed work to a mounting surface. The frame member(s) include a plurality of frame member portions that will be oriented toward the mounting surface when the framed work is mounted onto the surface. Each mounting element comprises magnetic material and adhesive material. The magnetic material and corresponding frame member portion provides magnetic coupling between the mounting element and the corresponding frame member portion that is used to releasably affix the frame members and the work to the mounting elements. The adhesive material is used to mount the resulting framed work to the surface by an adhesive bond between the mounting elements and the surface. Preferably, this adhesive bond is releasable such that the resulting framed work can be easily and quickly dismounted from the surface in a manner that does not impart scars or other damage to the surface. Preferably, the system includes a plurality of frame members whose positions relative to one another can be adjusted and fixed to form a frame that is adjustable to a user-selected size.

24 Claims, 2 Drawing Sheets

PICTURE FRAME SYSTEM

BACKGROUND OF THE INVENTION

1. Field of the Invention

This invention relates broadly to frames for pictures, drawings or the like. More particularly, this invention relates to adjustable-size frames and fixed-size frames.

2. State of the Art

It is often desirable to post and display various items. For example, at work, it is often desirable to prominently post documents such as event flyers, advertising and other promotional material, etc. At home, it is desirable to prominently post and display children's schoolwork or drawings, photographs, or craftwork. Typically, such items are posted with pins on a bulletin board, or on a metal surface (such as refrigerator) with magnets.

Note that these methods involve only posting of the work, and make no provision for framing of the work on a wall or other surface. Framing is advantageous in that it improves the aesthetic appearance of the work. However, prior art framing methods are expensive and time consuming when attaching the work to the frame. Moreover, such frames are mounted to a wall or other surface with mounting mechanisms (such as hooks or brackets) that scar the surface and require repair in the event that the framed work is removed/moved.

Thus, there is a need in the art for an improved framing system that provides a frame that is quickly and easily attached to a work and that is quickly and easily attached to a wall or other surface and dismounted from the surface without scarring the surface.

Moreover, the prior art framing mechanisms typically utilize a frame of fixed-size that can be used only for a particular size work. To alleviate this problem, several adjustable size frames have been proposed, including those in U.S. Pat. Nos. 1,711,039, 4,024,659, 5,448,841, and 5,579,596. However, such adjustable frames do not provide for quick and easy attachment of the work to the frame in addition to quick and easy attachment of the resultant framed work to a wall or other surface. Moreover, such adjustable frames do not provide for releasable attachment of the work to the frame in addition to releasable attachment of the resultant framed work to a wall or other surface. Such features are desirable because they enable quick and easy reuse of the frame for different works.

Thus, there is a need in the art for an improved framing system that provides an adjustable frame that is quickly and easily attached to a work and quickly and easily attached to a wall or other surface. In addition, there is a need in the art for an improved framing system that provides an adjustable frame that is releasably attached to a work and releasably attached to a wall or other surface.

SUMMARY OF THE INVENTION

It is therefore an object of the invention to provide an improved framing system that overcomes the limitations of prior art framing systems.

It is another object of the invention to provide a framing system that enables a frame to be quickly and easily attached to a work, and then quickly and easily mounted to a wall or other mounting surface.

It is a further object of the invention to provide a framing system that enables the framed work to be quickly and easily mounted and dismounted from a wall or other surface without imparting scars or other damage to the surface.

It is another object of the invention to provide an improved adjustable framing system that enables an adjustable frame to be quickly and easily attached to a work, and then quickly and easily mounted to a wall or other mounting surface.

It is a further object of the invention to provide an improved adjustable framing system that enables an adjustable frame to be releasably attached to a work, and then mounted to a wall or other mounting surface.

It is another object of the invention to provide an improved adjustable framing system that enables an adjustable frame and work affixed thereto to be releasably mounted to a wall or other mounting surface in a manner that does not impart scars or other damage to the surface.

It is also an object of the invention to provide an improved framing system which is of durable and reliable construction.

It is an additional object of the invention to provide an improved framing system which can be manufactured with low costs, and then can be sold to the consuming public at low costs, thereby making such improved framing systems economically available to the consuming public.

In accord with these objects, which will be discussed in detail below, the improved framing system of the present invention includes at least one frame member that cooperates with a plurality of mounting elements to mount the framed work on a mounting surface. The one or more frame members include a plurality of frame member portions that are made of metal (or other material that is magnetically attracted to the corresponding mounting element) and that are oriented toward the mounting surface when the framed work is mounted onto the mounting surface. Each mounting element comprises magnetic material and adhesive material. The magnetic material provides magnetic coupling between the mounting element and a corresponding frame member portion. This magnetic coupling is used to releasably affix both the frame member(s) and the work to the mounting elements. The adhesive material is used to mount the resulting frame structure to the mounting surface by an adhesive bond between the mounting elements and the mounting surface. Preferably, this adhesive bond is releasable such that the resulting framed work can be easily and quickly dismounted from the mounting surface without imparting scars or other damage to the surface. Preferably, the system includes a plurality of frame members whose positions relative to one another can be adjusted and fixed to form a frame that is adjustable to a user-selected size.

According to one embodiment of the invention, the frame member portions and mounting elements are L-shaped, and the mounting elements and corresponding frame member portions are disposed in the corner regions of a plurality of frame members.

According to another embodiment of the invention, the size of the frame structure is adjustable and set by frame members that telescopically slide relative to one another.

Additional objects and advantages of the invention will become apparent to those skilled in the art upon reference to the detailed description taken in conjunction with the provided figures.

DETAILED DESCRIPTION OF THE PREFERRED EMBODIMENTS

Figure 1:
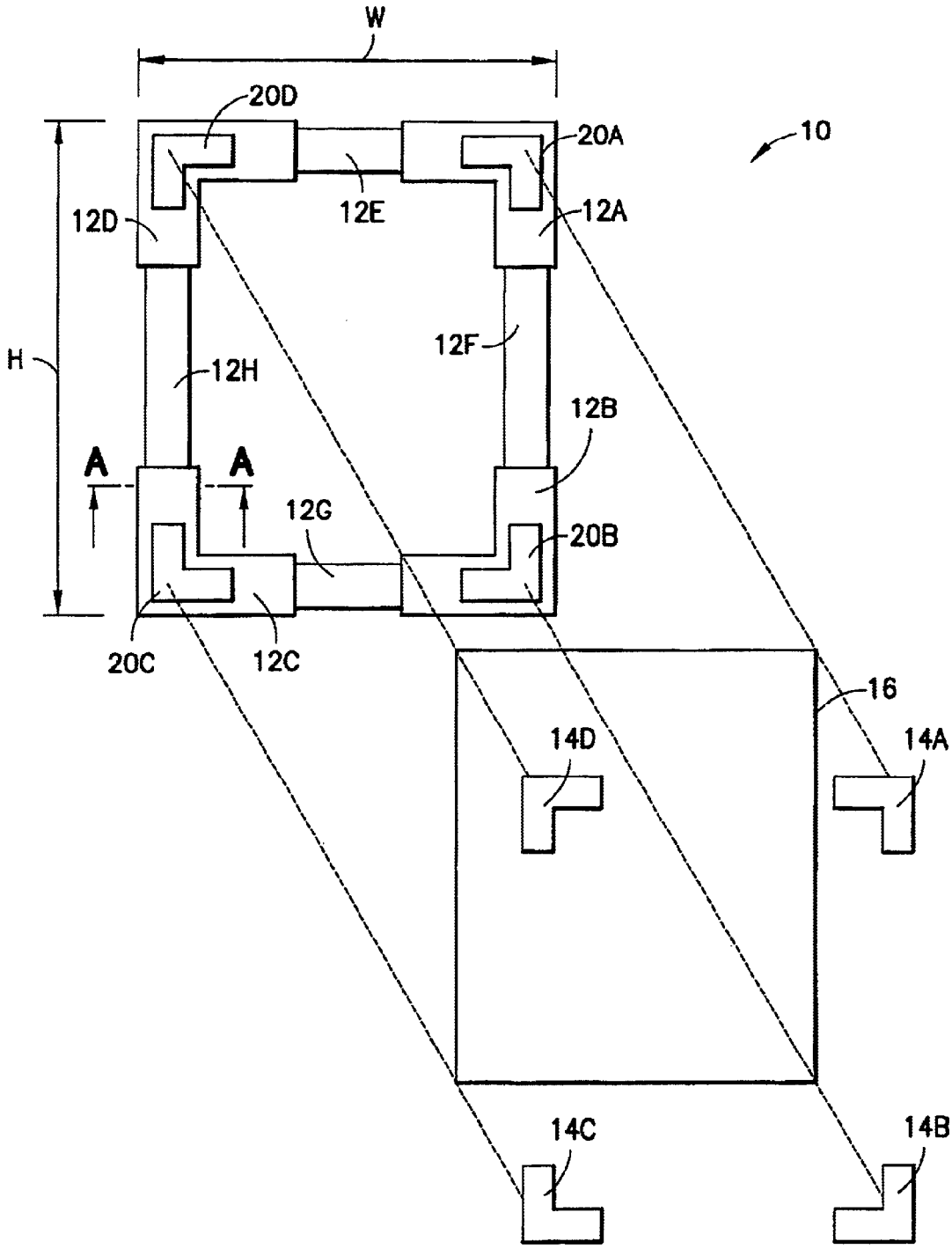
FIG. 1 is an exploded back elevational view of an exemplary framing system in accordance with the present invention.
Figure 2:
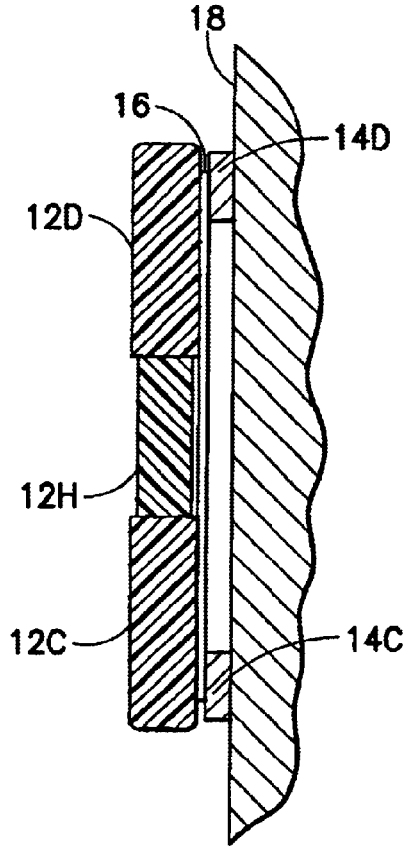
FIG. 2 is a side cross-sectional view of the exemplary framing system of FIG. 1 that shows the framing system mounted to a mounting surface.

Turning now to FIG. 1, there is shown an illustrative embodiment of the framing system 10 of the present invention, including one or more frame members 12 (eight shown as 12A, 12B, 12C, 12D, 12E, 12F, 12H, and 12G) that cooperate with a plurality of mounting elements 14 (four shown as 14A, 14B, 14C, and 14D) to surround a work 16 with the frame member(s) 12 and mount the resultant framed work to a surface 18 as best shown in FIG. 2. Preferably, the system includes a plurality of frame members 12 whose positions relative to one another can be adjusted and fixed to form a frame having a user-selected size. This may be accomplished by any one of a variety of mechanisms, including, but not limited to the following exemplary mechanisms:

i) utilizing telescoping frame members that are sized such that they snugly fit together, thereby enabling telescopic sliding relative to one another when manipulated by the user;

ii) utilizing telescoping frame members and spring-biased studs, wherein each stud protrudes through one or more holes (in a set of holes) in a given pair of telescoping frame members to thereby fix the relative position of the pair of telescoping frame members; an example of this mechanism is described in detail in U.S. Pat. No. 4,024,659 to Ingerdahl, herein incorporated by reference in its entirety;

iii) utilizing telescoping frame members and spring-biased stops, wherein each stop is affixed to a given frame member and is mated via the force provided by spring-bias to a groove (in a set of grooves) in another frame member to thereby fix the relative position of the pair of telescoping frame members; and iv) utilizing telescoping frame members and one or more screws (such as set screws—not shown), wherein each screw is screwed through a given frame member and rest against another frame member to thereby fix the relative position of the pair of telescoping frame members.

In the illustrative embodiment shown, four L-shaped frame members 12A, 12B, 12C, and 12D are slidably mated to straight members 12E, 12F, 12G and 12H such that their position relative to one another can be adjusted and fixed to form a rectangular frame that has a user-selected height (H) and width (W) dimension as shown. Preferably, the user-selected height and width of the rectangular frame can be made sufficiently large to surround a variety of paper sizes (for example, including 8.5 inch by 11 inch letter size paper, 8.5 inch by 17 inch legal size paper, etc). The frame member(s) 12 have a plurality of frame member portions 20 that are made of metal (or other material that is magnetically attracted to the corresponding mounting element) and that are oriented toward the mounting surface 18 when the framed work is mounted onto the surface 18 as best shown in FIG. 2. In this illustrative embodiment, the four L-shaped frame members 12A, 12B, 12C, and 12D have portions 20A, 20B, 20C and 20D. Preferably, the frame member(s) 12 are made of plastic; however alternative materials can be used. In addition, the frame member portions 20 are preferably recessed into the body of the frame member(s) 12 such that the work 16 will rest flush to the body of the frame member(s) 12 when mounted as best shown in FIG. 2.

As shown in FIG. 1, the plurality of mounting elements 14 (four shown as 14A, 14B, 14C, and 14D) cooperate with corresponding frame member portions 20 (four shown as 20A, 20B, 20C, and 20D) to support the frame member(s) 12 and the work 16. More specifically, each mounting element comprises magnetic material and adhesive material. The magnetic material provides magnetic coupling between the mounting element and the corresponding frame member portion. Such magnetic coupling is used to releasably affix the frame member(s) 12 and the work 16 to the mounting elements 14. The magnetic material of the mounting elements may be a rigid magnet, which is typically realized by a ferrite material that is magnetized. Alternatively, the magnetic material may be a flexible magnet, which is typically realized by a ferrite material that is magnetized and impregnated within a rubbery synthetic material. In yet another alternative, the magnetic material may be steel of any other material that is magnetically attracted to the corresponding frame member portion. The adhesive material, which may be an adhesive strip or foam tape strip or similar adhesive backed material, is provided on one side of the mounting elements 14 and is used to mount the resulting framed work to the surface 18 by an adhesive bond between the mounting elements 14 and the surface 18. Preferably, the adhesive bond between the mounting elements 14 and the surface 18 is releasable such that the resulting frame work can be easily and quickly dismounted from the surface 18 without imparting scarring or other damage to the surface 18. This feature may be realized with a releasable adhesive support system, such as the Command™ line of adhesive supports commercially-available from the 3M Company, Scotch® 859 Removable Mounting Squares that are commercially-available from the 3M Company, or similar adhesive systems.

FIG. 2 illustrates the framed work mounted onto the surface 18. The frame member(s) 12 (three shown as 12C, 12D and 12H ) and the work 16 are releasably affixed to the mounting elements 14 (two shown as 14C and 14D) by magnetic coupling between the frame member portions 20 (not shown in FIG. 2) and the magnetic mounting elements 14. In addition, the resultant framed work is mounted to the surface 18 by an adhesive bond between one side of the mounting elements 14 and the surface 18. Note that the peripheral region of the work 16 is covered by the frame member(s) 12, and the mounting elements 14 are disposed between this peripheral region and the mounting surface 18 as shown.

In the illustrative embodiments shown in FIGS. 1 and 2, the frame member portions 20 and the corresponding mounting elements 14 are L-shaped (or possibly another shape substantially providing a 90° corner) and are disposed in corner portions of the frame members 12A, 12B, 12C and 12D as shown. However, alternative configurations are contemplated such as using rectangular shapes, circular shapes, or any arbitrary shape for the frame member portions 20 and the corresponding mounting elements 14 (which need not necessarily correspond in shape to the metal portions 20). In addition, these elements can be disposed along the frame member(s) 12 in any arbitrary configuration, limited only by the constraint that these elements provide adequate support to hold the framed work to the mounting surface 18.

Figure 3:
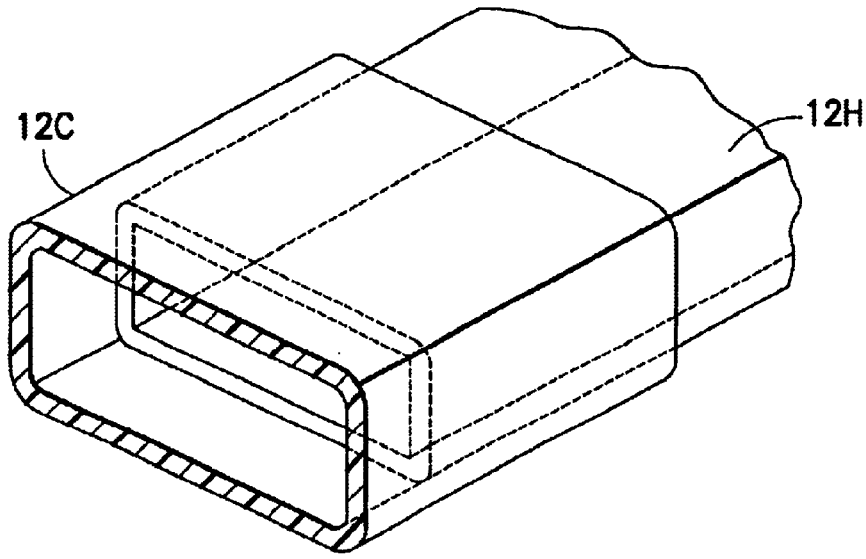
FIG. 3 is a perspective view of cross-section A—A of FIG. 1, which illustrates the use of telescoping tubular frame members to realize the adjustable frame structure of FIG. 1.

FIGS. 1 and 3 illustrates an exemplary adjustable frame structure that is suitable for realizing an adjustable frame in accordance with the present invention. The frame structure includes four frame members 12A, 12B, 12C, and 12D having an L-shape (or possibly another shape substantially providing a 90° corner) and four straight frame members 12E, 12F, 12G and 12H that are sized such that they can be manually slided and fixed relative to one another to form a rectangular frame that is adjustable to a user-selected height (H) and width (W) dimension such as shown in FIG. 1. FIG. 3 shows the cross-section A—A of FIG. 1 and depicts the telescoping tubular construction of two frame members 12C and 12H that enables slidable displacement of the two frame members with respect to one another. Similar construction is used for the other frame members to enable the frame members 12 to slide relative to one another to form a rectangular frame that is adjustable to a user-selected height (H) and width (W) dimension as shown.

In accordance with the present invention, the adjustable framing system is used to mount a framed work to a surface as follows. First, the plurality of frame members 12 as described above are manually manipulated (for example, by sliding the frame members relative to one another) such that the plurality of frame members 12 form a frame of a desired size. If not automatically accomplished, the frame members are manually fixed, e.g. via the use of set screws. Second, the work 16 is placed on the frame such that portions of the work 16 cover the portions 20 of the frame. Third, the work 16 is magnetically coupled to the frame by placing the plurality of mounting elements 14 on those portions of the work 16 that cover the portions 20 of the frame. Finally, the resultant frame structure is mounted to the surface 18 with the adhesive material (e.g., glue strip) provided by the mounting elements 14 that adhesively bonds the mounting elements 14 to the surface 16. This adhesive material preferably provides a releasable adhesive bond between the mounting elements 14 and the surface 18. In this configuration, the frame structure can be dismounted from the surface 18 by releasing the adhesive bond between the mounting elements 14 and the surface 18 in a manner that does not impart scarring or other damage to the surface 18.

It is also contemplated that the framing system of the present invention as described above can utilize a fixed-size frame. In this configuration, a unitary frame member 12 may be used to form a fixed-size frame. Alternatively, a plurality of frame members 12 may be mechanically affixed to one another (for example, utilizing joints and/or adhesives and/or screws and/or other mating mechanisms) at form the fixed-size frame. The fixed-size framing system is used to mount a framed work to a surface as follows. First, the work 16 is placed on the fixed-size frame such that portions of the work 16 cover the portions 20 of the frame. Second, the work 16 is magnetically coupled to the frame by placing the plurality of mounting elements 14 on those portions of the work 16 that cover the frame member portions 20 of the frame. Finally, the resultant frame structure is mounted to the surface 18 with the adhesive material (e.g., glue strip) provided by the mounting elements 14 that adhesively bonds the mounting elements 14 to the surface 16. This adhesive material preferably provides a releasable adhesive bond between the mounting elements 14 and the surface 18. In this configuration, the frame structure can be dismounted from the surface 18 by releasing the adhesive bond between the mounting elements 14 and the surface 18 in a manner that does not impart scarring or other damage to the surface 18.

The framing system of the present invention as described above is useful for quickly and easily mounting a wide variety of items on a wall. Such items may include schoolwork, drawings, photographs, craftwork or other documents. The framing system preferably does not utilize a glass window (or clear plastic window) between the frame members and the work, and thus provides cost savings by lowering the overall manufacturing costs of the system. However, it is contemplated that a window made from clear plastic (or glass or other glass-like material) can be added to the frame system. It is also contemplated that a large number of mounting elements (such as 12 mounting elements) will be packaged along with the frame members 12 that make up the frame. This enables the framing system to be reusable in that the frame members can be used to frame multiple items. It is also contemplated that the frame can be made in assorted colors, including black, white, green, etc and/or multi-colored schemes.

There have been described and illustrated herein several embodiments of an adjustable framing system and a corresponding method of use. While particular embodiments of the invention have been described, it is not intended that the invention be limited thereto, as it is intended that the invention be as broad in scope as the art will allow and that the specification be read likewise. Thus, while particular rectangular frame shapes have been disclosed, it will be appreciated that other frame shapes can be used as well. In addition, while particular types of telescopic frame assemblies have been disclosed, it will be understood that any adjustable frame assembly can be used. Also, while particular configurations of the magnetic material and adhesive material of the mounting elements have been disclosed, it will be recognized that such materials can be integrally formed into a multi-layer structure that provides both the magnetic coupling and adhesive bond required to support the frame structure. It will therefore be appreciated by those skilled in the art that yet other modifications could be made to the provided invention without deviating from its spirit and scope as claimed.

What is claimed is:

1. A framing system for mounting a work to a surface, said framing system comprising:

(a) a plurality of frame members that are slidably mated to one another to form a frame structure that is adjustable to a desired size, said frame structure for overlying the work, wherein said plurality of frame members comprise a plurality of frame member portions that are oriented toward said surface;

(b) a plurality of mounting elements detachably coupled to corresponding frame member portions, each mounting element comprising magnetic material and adhesive material, said magnetic material and corresponding frame member portion providing detachable magnetic coupling between said mounting element and the corresponding frame member portion, and said adhesive material affixing said mounting element to said surface;

wherein said work is removably supported in place between said plurality of mounting elements and said plurality of frame members by said magnetic coupling of said mounting elements to the corresponding frame member portions, and wherein said plurality of frame members and said work is mounted to said surface by said magnetic coupling of said mounting elements to the corresponding frame member portions and said adhesive material affixing said mounting elements to said surface.

2. A framing system according to claim 1, wherein:

said work has a peripheral region that is covered by said frame structure, and said plurality of mounting elements are disposed between said peripheral region and said surface.

3. A framing system according to claim 1, wherein:

said plurality of frame members are slidably mated to one another such that height and width of said frame can be changed.

4. A framing system according to claim 1, wherein:

said plurality of frame members are substantially made of plastic, and said frame member portions comprise metal that is affixed to plastic.

5. A framing system according to claim 1, wherein:

said frame member portions are part of four frame members each having an L-shape.

6. A framing system according to claim 5, wherein:

each of said four frame members has an L-shaped frame member portion that is oriented toward said surface.

7. A framing system according to claim 6, wherein:

said plurality of mounting elements comprise four mounting elements each having an L-shape that corresponds to said L-shaped frame member portions of said four corner frame members.

8. A framing system according to claim 1, wherein:

said adhesive material of said plurality of mounting elements is releasably affixed to said surface to enable removal of said mounting elements without scarring said surface.

9. A method of framing a work comprising the steps of:

(a) providing a plurality of frame members that are slidably mated to one another to form a frame structure that is adjustable to a desired size, said frame structure for overlying the work, wherein said plurality of frame members comprise a plurality of frame member portions that are to be oriented toward said surface;

(b) slidably adjusting positions of said plurality of frame members to form a frame of a desired size;

(c) providing a plurality of mounting elements adapted to detachable couple to corresponding frame member portions, each mounting element comprising magnetic material and adhesive material, said magnetic material and corresponding frame member portion providing detachable magnetic coupling between said mounting element and the corresponding frame member portion, and said adhesive material capable of affixing said mounting element to said surface;

(d) placing said work on said frame, and magnetically coupling said work to said frame by placing said plurality of mounting elements on portions of said work that cover the corresponding frame member portions; and (e) mounting the resultant frame structure to said surface with said adhesive material that affixes said plurality of mounting elements to said surface.

10. A method of framing a work according to claim 9, wherein:

said work has a peripheral region that is covered by said frame structure, and said plurality of mounting elements are placed on said peripheral region in step (d).

11. A method of framing a work according to claim 9, wherein:

step (b) includes the step of sliding said plurality of frame members relative to one another such that height and width of said frame is changed to a user-selected height and width.

12. A method of framing a work according to claim 9, wherein said plurality of frame members are substantially made of plastic, and said frame member portions comprise metal that is affixed to plastic.

13. A method of framing a work according to claim 9, wherein:

said frame member portions are provided by four frame members each having an L-shape.

14. A method of framing a work according to claim 13, wherein:

each of said four frame members has an L-shaped frame member portion that is oriented toward said surface.

15. A method of framing a work according to claim 14, wherein:

said plurality of mounting elements comprise four mounting elements each having an L-shape that corresponds to said L-shaped frame member portions of said four frame members.

16. A method of framing a work according to claim 9, further comprising the step of:

releasing said adhesive material from said surface such that said mounting elements are not affixed to said surface and said surface remains unscarred.

17. A framing system for mounting a work to a surface, said framing system comprising:

a) a plurality of frame members that are slidably mated to one another to form a frame structure that is adjustable to a desired size, said frame structure for overlying the work, wherein said plurality of frame members comprise a plurality of frame member portions that are to be oriented toward said surface; and b) a plurality of mounting elements adapted to detachable couple to corresponding frame member portions, each mounting element comprising magnetic material and adhesive material, wherein said magnetic material is used to provide detachable magnetic coupling between said mounting elements and the corresponding frame member portions, and said adhesive material is used to affix said plurality of mounting elements to said surface in order to mount said frame structure and said work on said surface.

18. A framing system according to claim 17, wherein:

said plurality of mounting elements are sized such that they fit between a peripheral region of said work that is covered by said frame structure and said surface.

19. A framing system according to claim 17, wherein:

said plurality of frame members are capable of being slidably mated to one another such that height and width of said frame can be changed.

20. A framing system according to claim 17, wherein:

said plurality of frame members are substantially made of plastic, and said frame member portions comprise metal that is affixed to plastic.

21. A framing system according to claim 17, wherein:

said frame member portions are provided by four frame members each having an L-shape.

22. A framing system according to claim 21, wherein:

each of said four frame members has an L-shaped frame member portion that is oriented toward said surface.

23. A framing system according to claim 22, wherein:

said plurality of mounting elements comprise four mounting elements each having an L-shape that corresponds to said L-shaped frame member portions of said four frame members.

24. A framing system according to claim 17, wherein:

said adhesive material of said plurality of mounting elements can be releasably affixed to said surface such that said surface remains unscarred.

* * * * *